US010914459B2

(12) United States Patent
Yang et al.

(10) Patent No.: US 10,914,459 B2
(45) Date of Patent: Feb. 9, 2021

(54) LED RACK SYSTEM

(71) Applicant: LONGHORN INTELLIGENT TECH CO., LTD, Shenzhen (CN)

(72) Inventors: Haitao Yang, Shenzhen (CN); Lin Yang, Shenzhen (CN); Zhengping Huang, Shenzhen (CN); Lei Li, Shenzhen (CN)

( * ) Notice: Subject to any disclaimer, the term of this patent is extended or adjusted under 35 U.S.C. 154(b) by 0 days.

(21) Appl. No.: 16/546,594

(22) Filed: Aug. 21, 2019

(65) Prior Publication Data

US 2020/0370737 A1 Nov. 26, 2020

Related U.S. Application Data

(63) Continuation-in-part of application No. PCT/CN2019/087817, filed on Jun. 6, 2019, and a continuation-in-part of application No. 16/517,352, filed on Jul. 19, 2019, and a continuation-in-part of application No. 16/538,632, filed on Aug. 12, 2019.

(30) Foreign Application Priority Data

May 21, 2019 (CN) ..... 2019 2 0738978 U

(51) Int. Cl.

| | |
|---|---|
| ***F21S 8/02*** | (2006.01) |
| ***F21Y 115/10*** | (2016.01) |
| ***F21V 21/03*** | (2006.01) |
| ***F21V 23/00*** | (2015.01) |

(52) U.S. Cl.

CPC ..... *F21V 21/03* (2013.01); *F21S 8/026* (2013.01); *F21V 23/008* (2013.01); *F21Y 2115/10* (2016.08)

(58) Field of Classification Search

CPC ..... F21S 8/026; F21S 8/028; F21S 8/02

See application file for complete search history.

(56) References Cited

U.S. PATENT DOCUMENTS

| | | | | |
|---|---|---|---|---|
| 3,078,366 | A * | 2/1963 | Winkler | F21S 8/04 362/223 |
| 8,100,551 | B2 | 1/2012 | Mayfield, III | |
| 8,523,383 | B1 | 9/2013 | Grigore | |
| 8,794,787 | B2 * | 8/2014 | Boyer | F21V 7/0083 362/235 |
| 8,870,407 | B2 * | 10/2014 | Kim | F21V 15/01 362/217.1 |
| 9,206,948 | B1 * | 12/2015 | Scribante | F21K 9/275 |
| 9,279,553 | B1 | 3/2016 | Scribante | |
| 9,541,255 | B2 * | 1/2017 | Sferra | F21V 7/0083 |
| 2007/0211457 | A1 | 9/2007 | Mayfield, III | |

(Continued)

*Primary Examiner* — Jong-Suk (James) Lee
*Assistant Examiner* — Eric T Eide
(74) *Attorney, Agent, or Firm* — Clement Cheng

(57) ABSTRACT

An LED rack system for a troffer retrofit has a rail structure with a front rail, rear rail, right rail, and a left rail. The left rail is spaced apart from and parallel to the right rail. The front rail is spaced apart from and parallel to the rear rail. The rear rail is connected to the right rail and the left rail. The front rail is connected to the right rail and the real rail. A reflector is mounted to the rail structure. The reflector includes a reflector planar portion. The reflector planar portion has column supports and row supports. The column supports and the row supports are formed as linear intersecting protrusions from the planar portion.

7 Claims, 6 Drawing Sheets

(56) References Cited

U.S. PATENT DOCUMENTS

| | | | | |
|---|---|---|---|---|
| 2009/0103288 | A1* | 4/2009 | Boyer | F21V 7/04 362/153.1 |
| 2009/0207603 | A1 | 8/2009 | Lydecker | |
| 2010/0091484 | A1 | 4/2010 | Mayfield, III | |
| 2010/0135006 | A1* | 6/2010 | Huang | F21V 19/001 362/185 |
| 2010/0182789 | A1* | 7/2010 | Tsai | F21S 8/026 362/294 |
| 2013/0265751 | A1* | 10/2013 | Edmond | F21S 8/026 362/231 |
| 2018/0128456 | A1* | 5/2018 | Zhang | F21V 17/108 |

* cited by examiner

LED RACK SYSTEM

This application claims priority from earlier filed PCT application number PCT/CN2019/087817 entitled Lamp Body Structure And Panel Lamp by applicant Longhorn Intelligent Tech Co., Ltd. filed Jun. 6, 2019 having the same inventors. This application also claims priority from China Utility Model 201920738978.6 entitled Lamp Body Structure And Panel Lamp by applicant Longhorn Intelligent Tech Co., Ltd. filed May 21, 2019, also having the same inventors.

This application claims priority from U.S. non-provisional application by first named inventor Haitao Yang entitled LAMP BODY STRUCTURE AND PANEL LAMP filed Jul. 19, 2019. This application also claims priority from United States non-provisional application by first named inventor Haitao Yang's entitled LED GROOVE SYSTEM Ser. No. 16/538,632 filed Aug. 12, 2019. The disclosures of the above priority documents are incorporated herein by reference.

FIELD OF THE INVENTION

The present invention is in the field of light fixture structures, specifically LED rack systems.

DISCUSSION OF RELATED ART

A variety of different light fixture frames and mechanisms are taught in the patent literature. For example, in the U.S. Pat. No. 8,523,383, Retrofitting Recessed Lighting Fixtures by inventor Valerica Grigore, published Sep. 3, 2013 the abstract discloses, "A retrofit kit assembly for a recessed lighting fixture and methods for manufacturing and installing the same are described herein. The retrofit kit includes at least two mounting brackets, which can each include at least one lamp socket. The kit also includes at least one ballast, which may be pre-wired to the sockets. Each ballast may include a temporary adhesive on a mounting side thereof, for use during the installation process. For example, the installer may provisionally mount the ballast to an interior surface of an existing housing of the fixture and then permanently mount the ballast using one or more fasteners. The mounting brackets and ballast of the kit may include captive hardware which is held in place in the aperture for the fastener prior to fastening the particular object to the recessed housing, which reduces risk of dropping or losing fasteners during installation."

For example, in the U.S. Pat. No. 8,100,551, Replacement Light Fixture And Lens Assembly For Same by inventor John T. Mayfield, III, published Jan. 24, 2012 the abstract discloses, "A replacement light fixture for directing light emitted from a light source toward an area to be illuminated, including a base member upon with the light source is positioned and a reflector assembly detachably secured to a first and second mounting brackets that are mounted to a portion of the preexisting light fixture housing such that a lens portion of the reflector assembly overlies the light source and such that substantially all of the light emitted from the light source passes through the lens portion."

For example, in the United States publication number 2007/0211457, Replacement Light Fixture And Lens Assembly For Same by inventor John Mayfield, published Sep. 13, 2007 the abstract discloses, "A replacement light fixture for directing light emitted from a light source toward an area to be illuminated, including a base member upon with the light source is positioned and a reflector assembly detachably secured to a first and second mounting brackets that are mounted to a portion of the preexisting light fixture housing such that a lens portion of the reflector assembly overlies the light source and such that substantially all of the light emitted from the light source passes through the lens portion."

For example, in the United States publication number 2010/0091484, Replacement Light Fixture And Lens Assembly For Same by inventor John T. Mayfield, III, published Apr. 5, 2010 the abstract discloses, "A replacement light fixture for directing light emitted from a light source toward an area to be illuminated, including a base member upon with the light source is positioned and a reflector assembly detachably secured to a first and second mounting brackets that are mounted to a portion of the preexisting light fixture housing such that a lens portion of the reflector assembly overlies the light source and such that substantially all of the light emitted from the light source passes through the lens portion."

For example, in the United States publication number 2009/0207603, Retrofit Light Assembly by inventor Stephen Haight Lydecker, published Aug. 20, 2009 the abstract discloses, "A package delivery notification and protection device includes a package sensor including a placement surface. The package sensor is configured to generate a sensor signal indicating whether a package has been placed on or removed from the placement surface. Wireless communications circuitry is configured to communicate over a wireless network and processing circuitry is coupled to the package sensor and to the wireless communications circuitry to communicate over the wireless network."

For example, in the U.S. Pat. No. 9,279,553, Periphery-Lit Troffer Light Fixture Retrofit Systems And Methods by inventor John Scribante, published Mar. 8, 2016 the abstract discloses, "A retrofitting kit includes at least one of an adapter bracket and a retainer configured to engage at least one of an existing troffer light fixture and a T-bar of a ceiling system and a door assembly configured to be held in the ceiling system by the at least one of the adapter bracket and the retainer. The door assembly includes a lens, a housing configured to hold the lens, the housing including one or more sidewalls disposed around a periphery of the lens, where the one or more sidewalls extend upward, away from the lens to define a cavity, and a plurality of LEDs having primary light axes extending inward into the cavity. The plurality of LEDs are coupled to the one or more sidewalls and positioned to illuminate the lens from behind with a uniform distribution of light when engaged." The above references are incorporated herein by reference.

SUMMARY OF THE INVENTION

An LED rack system for a troffer retrofit has a rail structure with a front rail, rear rail, right rail, and a left rail. The left rail is spaced apart from and parallel to the right rail. The front rail is spaced apart from and parallel to the rear rail. The rear rail is connected to the right rail and the left rail. The front rail is connected to the right rail and the real rail. A reflector is mounted to the rail structure. The reflector includes a reflector planar portion. The reflector planar portion has column supports and row supports. The column supports and the row supports are formed as linear intersecting protrusions from the planar portion.

The right rail is configured to engage to a right troffer wall and the left rail is configured to engage to a left troffer wall. The column supports and the row supports are embossed. A driver is mounted within a driver housing. The driver housing is mounted to a reflector sidewall. The reflector sidewall includes a reflector front sidewall, a reflector rear sidewall, a reflector left sidewall, and a reflector right sidewall.

The LED rack system also preferably has connector hooks, namely a first swivel hook, a second swivel hook, a third swivel hook, and a fourth swivel hook, wherein the first swivel hook and the second swivel hook are mounted to a reflector right sidewall. The third swivel hook and the fourth swivel hook are mounted to a reflector left sidewall. The connector hooks are configured to engage to the rail structure. The driver housing preferably has a beveled side that matches a sloped sidewall of the reflector.

The grid protrusion can retain LED strips on an underside of the reflector. The grid protrusion allows LED strips to be mounted in rows or columns. The LED protrusion forms a groove on an underside of the reflector which allows LED strips to be mounted in the grooves on the underside of the reflector. Therefore, it is an object of the invention to provide a grid pattern that aligns installation of the LED strips while providing improved structural stability and rigidity during installation.

The following call out list of elements can be a useful guide in referencing the elements of the drawings.

20 Rails
21 Right Rail
22 Left Rail
23 Front Rail
24 Rear Rail
25 Second Right Rail Upright Section
26 Flex Opening
27 First Hook Slot
28 Second Hook Slot
29 Reflector
30 Troffer
31 Right Troffer Wall
32 Left Troffer Wall
33 Front Troffer Wall
34 Rear Troffer Wall
35 Third Hook Slot
36 Fourth Hook Slot
37 Left Rail Horizontal Section
40 T-Bar Structure
42 Left T-Bar
43 Front T-Bar
44 Rear T-Bar
45 Beveled Side
46 Reflector Rear Sidewall
47 Reflector Front Sidewall
48 Reflector Right Sidewall
49 Reflector Left Sidewall
50 Hook
51 First Swivel Hook
52 Second Swivel Hook
53 Third Swivel Hook
54 Fourth Swivel Hook
55 Lens
56 Grid Protrusion
57 Driver
58 Stabilizing Depression
59 Driver Housing
60 Rail Structure
61 Front Rail Right Tab
62 Right Rail Front Slot
63 Rear Rail Right Tab
64 Right Rail Rear Slot
65 Right Rail Foot
66 Right Rail Swivel Mounting Slot
67 First Arm Extension Tab
68 First Right Rail Upright Section
69 Second Arm Extension Tab
70 Right Rail Horizontal Section
71 Left Rail Foot
72 Front Rail Left Tab
73 Left Rail Front Tab
74 Left Rail Front Slot
75 Left Rail Rear Slot
76 First Arm Extension
77 Second Arm Extension
81 Reflector Planar Portion
82 Column Supports
83 Row Supports

DETAILED DESCRIPTION OF THE PREFERRED EMBODIMENT

Figure 1:
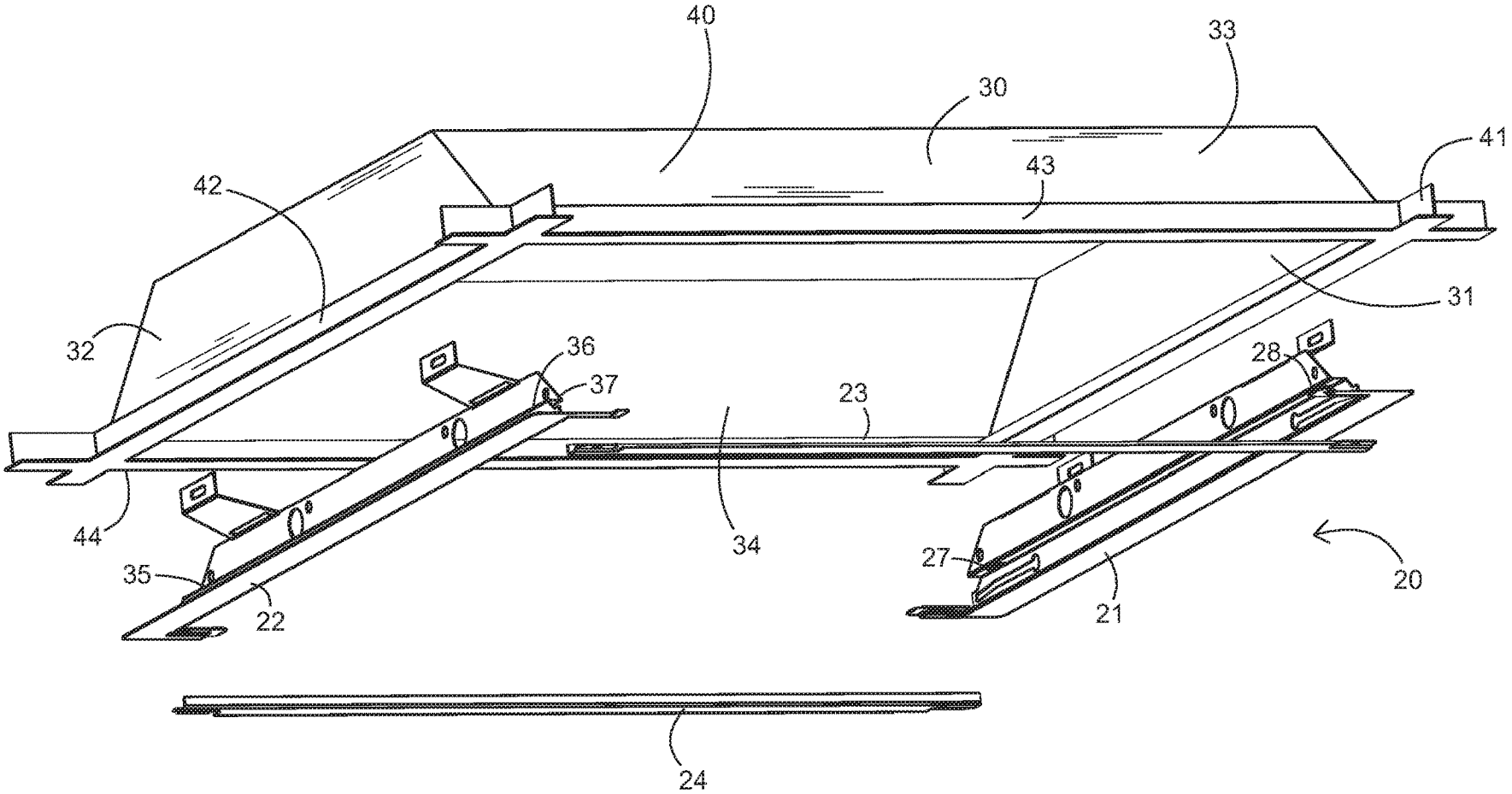
FIG. 1 is a lamp panel with mounting brackets.

As seen in FIG. 1, in an LED troffer 30, the recess of the troffer is retained above a T-bar structure 40. The T-bar structure includes a front T-bar 43, a right T-bar 41, a left T-bar 42, and a rear T-bar 44. The T-bar structure forms a rectangular grid that receives one or more troffers 30. When retrofitting lights, the T-bar structure would obstruct installing additional retrofit railing, however the present invention uses the T-bar structure 40 to expedite the installing additional retrofit railing.

The retrofit structure includes rails 20 forming a rail structure 60 having a right rail 21, and a left rail 22 spaced apart from and parallel to the right rail 21. The front rail 23 is parallel to a rear rail 24 and the front and rear rail are spaced apart from each other. The front rail 23 is connected to the right rail 21 and the left rail 22. The rear rail 24 is connected to the right rail 21 and the left rail 22. The right rail 21 engages to the right troffer wall 31. The left rail 22 is connected to the left troffer wall 32.

Figure 2:
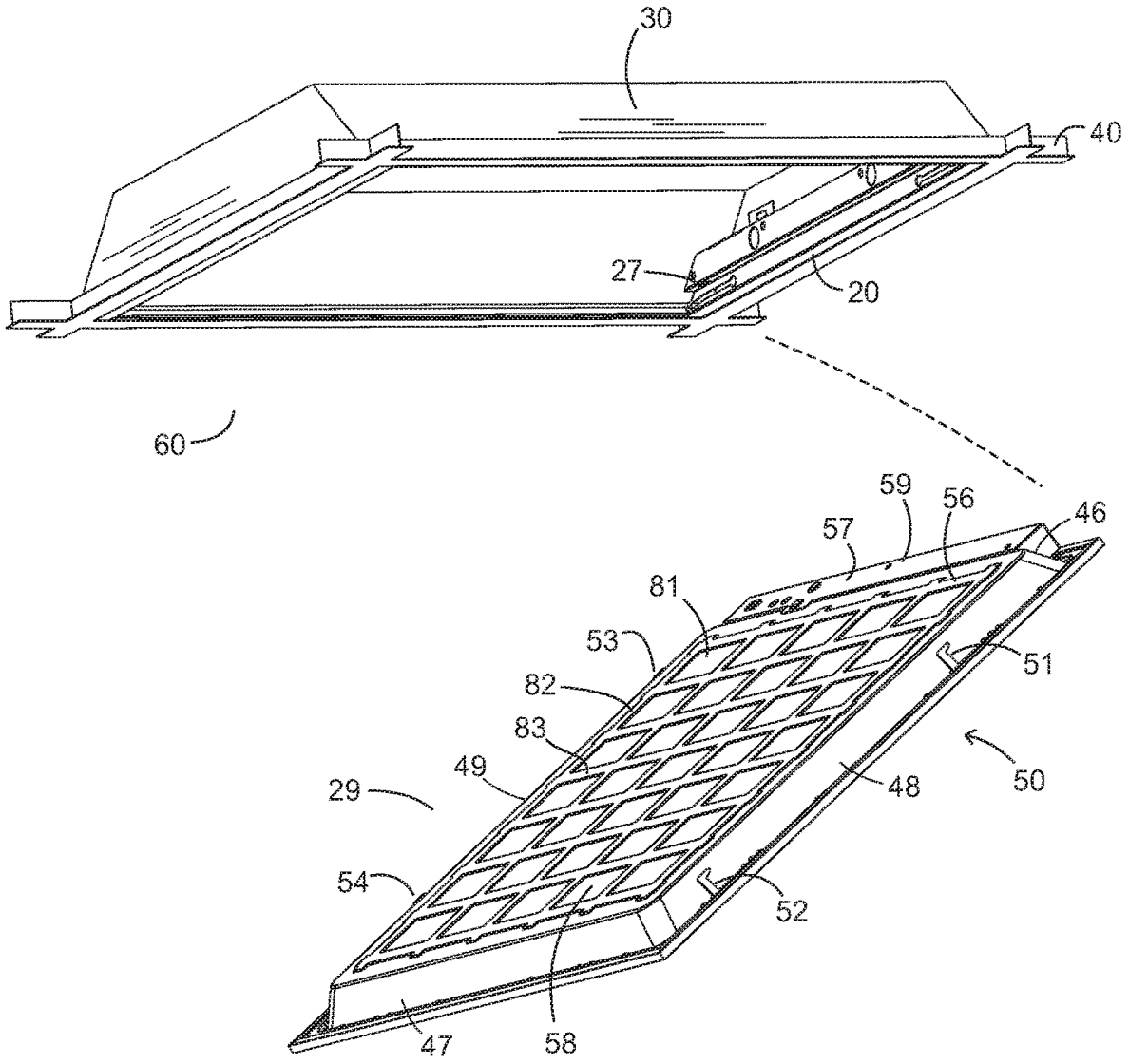
FIG. 2 is a lamp panel with a replacement panel light.

As seen in FIG. 2, the rail structure 60 retains the reflector 29. Hooks 50 can connect to slots formed in the rails. The first swivel hook 51 is parallel to the second swivel hook 52 and engages the right rail 21. The right rail 21 has a first hook slot 27 and the second hook slot 28. The first swivel hook 51 engages the first hook slot 27 and the second swivel hook 52 engages the second hook slot 28. Similarly, the third swivel hook 53 is parallel to the fourth swivel hook 54 and engages the left rail 24. The left rail 24 has a third hook slot 35 and a fourth hook slot 36. The third swivel hook 53 engages the third hook slot 35 and the fourth swivel hook 54 engages the fourth hook slot 36.

Additionally, the driver 57 has a driver housing 59 that has a beveled side 45. The beveled side 45 is a slanted profile that conforms to and can be parallel to a reflector rear sidewall 46. The reflector is preferably rectangular so that the reflector rear sidewall is opposite a reflector front sidewall 47, and a reflector right sidewall 48 is parallel to a reflector left sidewall 49.

The reflector 29 has a reflector planar portion 81. The reflector planar portion 81 is generally flat, but has a grid shaped embossment. The grid shaped embossment is formed with a plurality of stabilizing depressions 58. The stabilizing depressions are rectangular and form an array of grid protrusions 56 with column supports 82 and row supports 83. The reflector 29 can be made by heat pressing a plastic panel, or by pressing sheet metal to emboss with stabilizing depressions 58. The stabilizing depressions 58 are oriented in a regular rectangular array or hexagonal array. The stabilizing depressions can be triangular, rectangular, round or hexagonal. The column supports 82 and row supports 83 form a regular pattern such as a five by seven grid. A driver 57 is mounted in a driver housing 59 in a driver mounting area.

Figure 3:
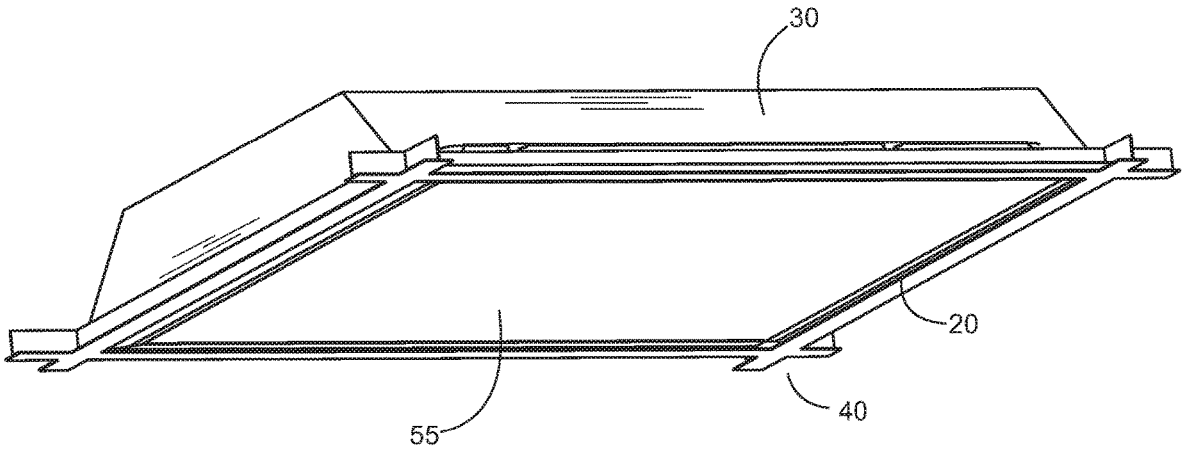
FIG. 3 is a lamp panel with a panel light attached.

As seen in FIG. 3, a lens 55 covers the reflector 29. The rails 20 mounts to the troffer 30. The rails 20 and troffer 30 mount to the T-bar structure 40.

Figure 4:
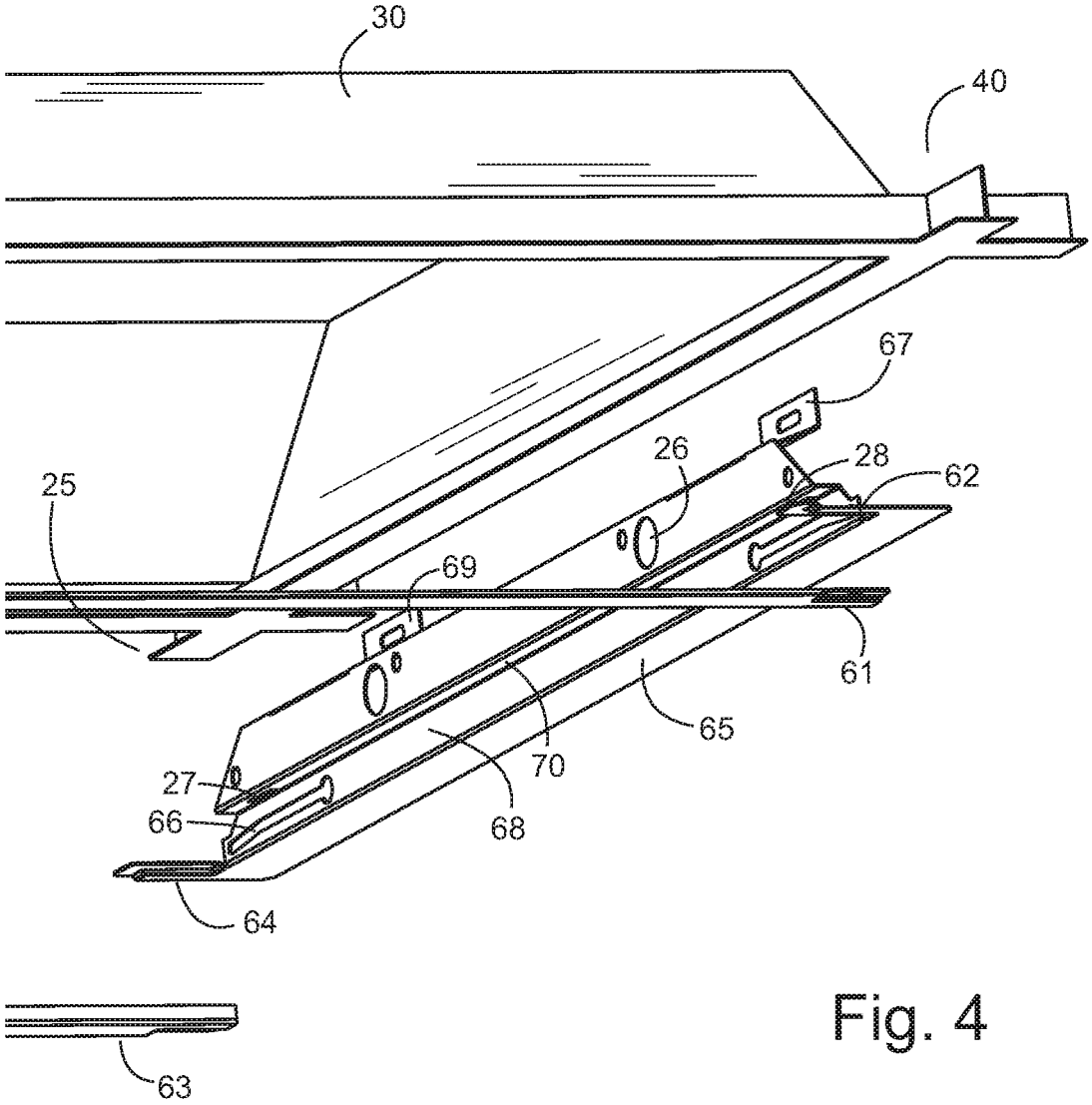
FIG. 4 is a detail close-up of the mounting brackets.

As seen in FIG. 4, the side rails have upright sections and horizontal sections such as the right rail horizontal section 70. The upright sections are planar and can be parallel to but not coplanar with each other. For example, the right rail has a first right rail upright section 68, and a second right rail upright section 25 can be laterally offset from each other by a distance of the width of the right rail horizontal section 70. The right rail also has a right rail foot 65. The right rail front slot extending from a front portion of the right rail receives a front rail right tab 61. The front rail right tab is formed on the front rail. The right rail also has a right rail rear slot 64. The right rail rear slot 64 receives the rear rail right tab 63 formed on the rear rail. The first hook slot 27 and the second hook slot 20 are formed on the right rail horizontal section 70. The second right rail upright section 25 has a first rail arm 67 and a second rail arm 69 extending therefrom.

A right rail 21 has a right rail foot 65 that is planar and horizontally oriented and configured to wedge between the right T-bar 41 and the right troffer wall 31. The right rail 21 then continues from the right rail foot upward to a first right rail upright section 68. The first right rail up right section 68 connects to the right rail horizontal section 70. The right rail horizontal section 70 extends upward to a second right rail upright section 25.

Figure 5:
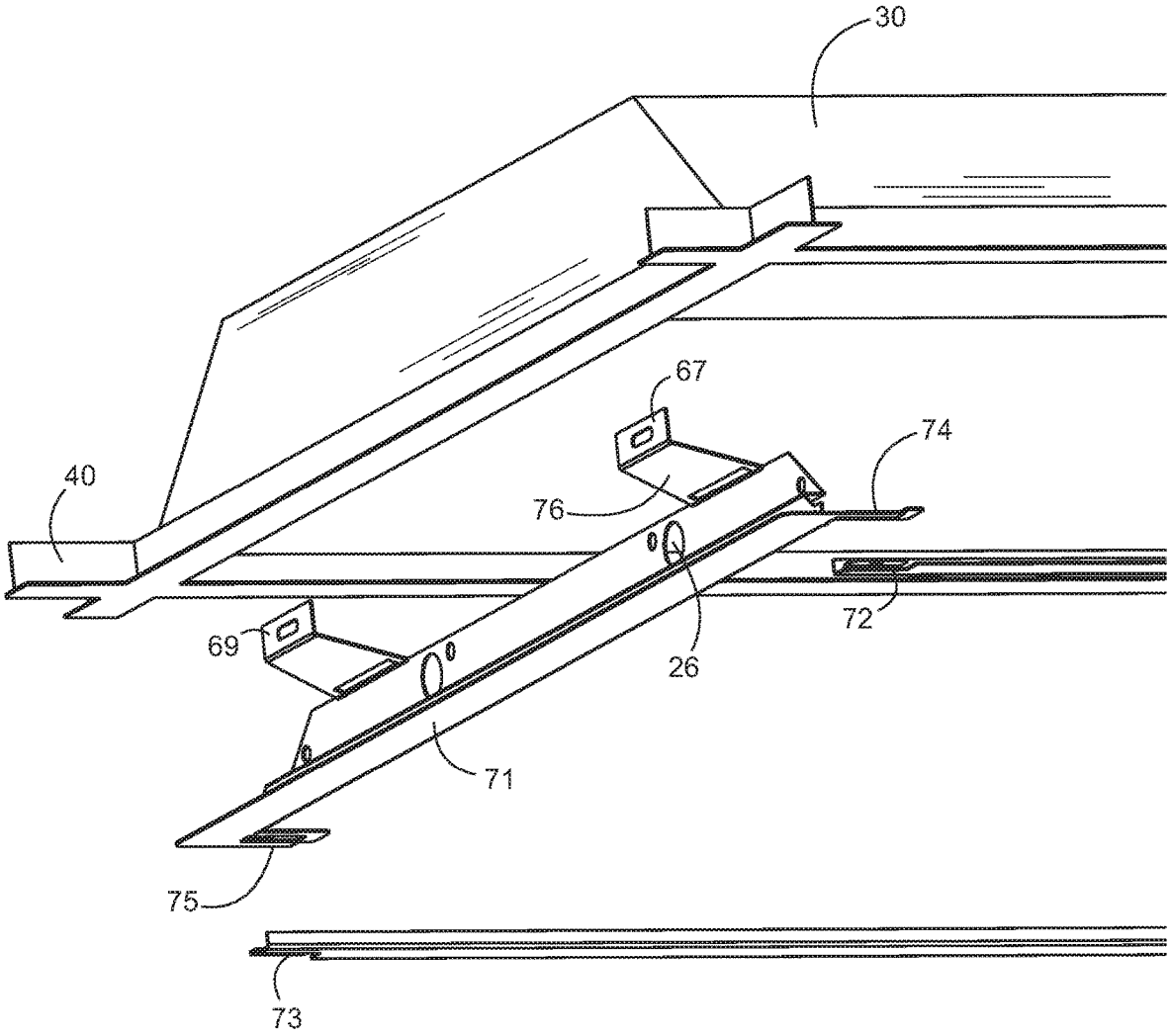
FIG. 5 is a close-up of a lamp panel with mounting brackets.
Figure 6:
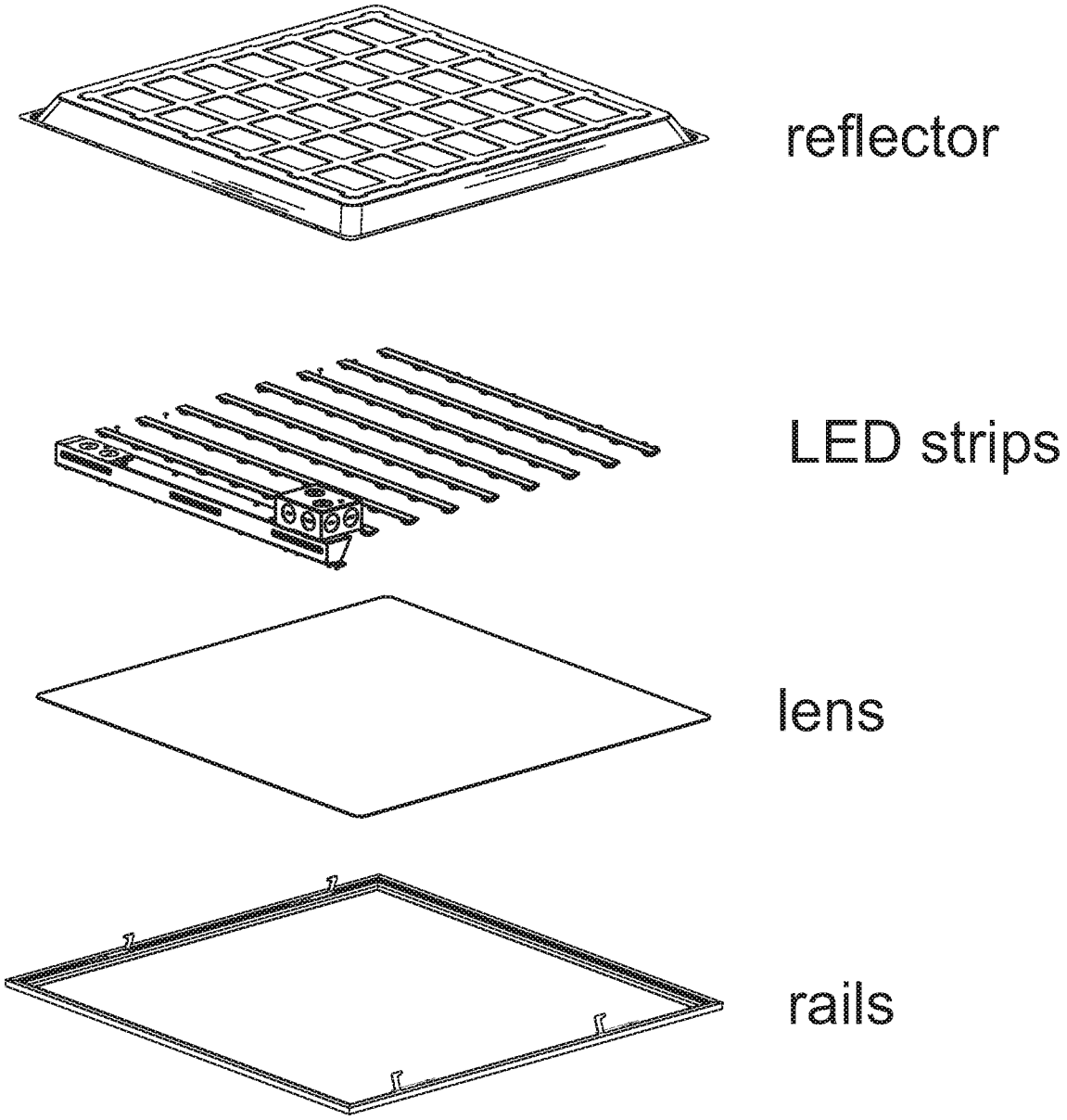
FIG. 6 is a is an exploded view diagram showing the assembly of the lamp panel.

As seen in FIG. 5, the left rail has a left rail foot 71 that similarly fits between the left T-bar and the left troffer wall. The configuration of the left rail is analogous to the right rail. The left rail also includes a first arm extension 76 and a second arm extension 77. The left rail also has a left rail front slot 74 formed on the left rail foot 71 that receives a front rail left tab 72. Also, the rear rail left tab 73 engages the left rail rear slot 75 that is formed on the left rail foot 71. The reflector 29 is a panel lamp reflector and the lens 55 is a panel lamp lens. The left rail also has a flex opening 26 that can be a circular or oval for providing flexibility to the left rail. The flex opening 26 can be formed in a pair on the left rail similarly as on the right rail as seen in the previous figure.

The flex opening 26 is formed on a vertical section of the right or left rail so that the right or left rail has a torsional flexibility for receiving the reflector of the panel light. Optionally, the front rail left tab 72 and the left rail front slot 74 can be reversed so that the left rail front slot 74 is mounted on the front rail, and the front rail left tab is mounted on the left rail. Similarly, the rear rail left tab 73 can be reversed with the left rail rear slot 75 so that the rear rail left tab 73 is mounted to the left rail, and the left rail rear slot 75 is mounted to the rear rail.

Preferably, the first arm extension tab 67 is mounted on a first arm extension 76 and the second arm extension tab 69 is mounted on a second arm extension 77. The first arm extension 76 and the second arm extension 77 extend from a second left rail upright section. The second left rail upright section extends from a horizontal rail portion, and the horizontal rail portion extends from a first left rail upright section. The first left rail upright section extends from the left rail foot 71. The third hook slot 35 and the fourth hook slot 36 are preferably formed on the left rail horizontal section 37.

The invention claimed is:

1. An LED rack system for a troffer retrofit comprising:

a. a rail structure including a front rail, rear rail, right rail, and a left rail, wherein the left rail is spaced apart from and parallel to the right rail, wherein the front rail is spaced apart from and parallel to the rear rail, wherein the rear rail is connected to the right rail and the left rail, and wherein the front rail is connected to the right rail and the real rail, wherein the right rail is configured to engage to a right troffer wall and the left rail is configured to engage to a left troffer wall;

b. a reflector mounted to the rail structure, wherein the reflector includes a reflector planar portion, wherein the reflector planar portion has column supports and row supports, wherein the column supports and the row supports are formed as linear intersecting protrusions formed on the planar portion, wherein the column supports and the row supports are formed as elongated channels that intersect;

c. an array of grid shaped protrusions formed from the linear intersecting protrusions, wherein stabilizing depressions are formed in a regular array between the linear intersecting protrusions, wherein the column supports and the row supports are embossed in a rectangular grid to form the stabilizing depressions as rectangular embossments formed between the column supports and the row supports;

d. LED strips mounted to the reflector;

e. a driver mounted within a driver housing, wherein the driver housing is mounted to a reflector sidewall, wherein the reflector sidewall includes a reflector front sidewall, a reflector rear sidewall, a reflector left sidewall, and a reflector right sidewall; and f. a lens mounted to the reflector at the reflector front sidewall, the reflector rear sidewall, the reflector left sidewall, and the reflector right sidewall; and g. connector hooks, namely a first swivel hook, a second swivel hook, a third swivel hook, and a fourth swivel hook, wherein the first swivel hook and the second swivel hook are mounted to the reflector right sidewall, and wherein the third swivel hook and the fourth swivel hook are mounted to the reflector left sidewall, wherein the connector hooks are configured to engage to the rail structure.

2. The LED rack system of claim 1, further including a driver housing that has a beveled side that matches a sloped sidewall of the reflector.

3. The LED rack system of claim 1, wherein the side rails have upright sections and horizontal sections including a right rail horizontal section, wherein the upright sections are planar and parallel each other, wherein the right rail has a first right rail upright section, and a second right rail upright section laterally offset from the first right rail upright section by a distance of a width of the right rail horizontal section.

4. The LED rack system of claim 3, further including a right rail foot formed on the right rail, and a right rail front slot extending from a front portion of the right rail that receives a front rail right tab, where a front rail right tab is formed on the front rail, wherein the right rail also has a right rail rear slot, wherein the right rail rear slot receives the rear rail right tab formed on the rear rail, wherein a first hook slot and a second hook slot are formed on the right rail horizontal section, wherein the second right rail upright section has a first rail arm and a second rail arm extending therefrom.

5. The LED rack system of claim 4, wherein the right rail foot is planar and horizontally oriented and configured to wedge between a right T-bar and a right troffer wall, wherein the right rail continues from the right rail foot upward to a first right rail upright section, wherein the first right rail upright section connects to the right rail horizontal section, and wherein the right rail horizontal section extends upwardly to the second right rail upright section.

6. The LED rack system of claim 5, wherein the left rail has a first left rail upright section, and a second left rail upright section laterally offset from the first left rail upright section by a distance of a width of the left rail horizontal section; and further including a left rail foot formed on the left rail, and a left rail front slot extending from a front portion of the left rail that receives a front rail left tab, where a front rail left tab is formed on the front rail, wherein the left rail also has a left rail rear slot, wherein the left rail rear slot receives the rear rail left tab formed on the rear rail, wherein a first hook slot and a second hook slot are formed on the left rail horizontal section, wherein the second left rail upright section has a first rail arm and a second rail arm extending therefrom.

7. The LED rack system of claim 6, wherein the left rail foot is planar and horizontally oriented and configured to wedge between a left T-bar and a left troffer wall, wherein the left rail continues from the left rail foot upward to a first left rail upright section, wherein the first left rail upright section connects to the left rail horizontal section, and wherein the left rail horizontal section extends upwardly to the second left rail upright section.

* * * * *